United States Patent [19]

Alekhin et al.

[11] 3,986,378

[45] Oct. 19, 1976

[54] METHOD OF REDUCTION OF AN OXIDIZED SURFACE OF COPPER OR ITS ALLOYS

[76] Inventors: Vladimir Yakovlevich Alekhin, ulitsa F. Khodzhaeva, 18, kv. 21; Mark Moiseevich Ioff, ulitsa Vakhshskaya, 7, kv. 4; Antonina Mikhailovna Streshneva, ulitsa Pobedy, 22, all of Tashkent, U.S.S.R.

[22] Filed: June 16, 1975

[21] Appl. No.: 586,861

Related U.S. Application Data

[63] Continuation of Ser. No. 94,156, Dec. 1, 1970, abandoned.

[52] U.S. Cl. ..... 72/38; 72/39

[51] Int. Cl.[2] ..... B21B 9/00; B21B 45/04; B21C 43/00

[58] Field of Search ..... 29/81 R, 81 B, 81 C, 29/81 F; 72/38, 39, 46; 117/49; 134/2, 9, 19; 252/49.3

[56] References Cited

UNITED STATES PATENTS 3,608,344 9/1971 Schwan ..... 72/38

OTHER PUBLICATIONS

Lubrication in the Drawing of Metals, Samuel Spring, from "Steel", p. 21, Aug. 20, 1945.

Uses and Applicatons of Chemicals and Related Materials, T. C. Gregory, vol. I (1939), pp. 15, 17.

*Primary Examiner*—C.W. Lanham
*Assistant Examiner*—E. M. Combs
*Attorney, Agent, or Firm*—Holman & Stern

[57] ABSTRACT

A method of reduction of an oxidized surface of copper or its alloys in the process of hot working thereof, in which the oxidized surface is treated with water, an aqueous emulsion or steam, containing at least 0.15 per cent of ethyl alcohol, when carrying into effect hot working or immediately thereafter.

2 Claims, No Drawings

METHOD OF REDUCTION OF AN OXIDIZED SURFACE OF COPPER OR ITS ALLOYS

This is a continuation of application Ser. No. 94,156 filed Dec. 1, 1970, abandoned.

BACKGROUND OF THE INVENTION

The present invention relates to metallurgy, and more particularly to methods of reduction of an oxidized surface of metals.

Known in the prior art is a method of cleansing an oxidized surface of copper by etching. (I. D. Troitsky et al., "Proizvodstvo Elektricheskikh Kabelei i Provodov s Rezinoplastmassovoi Izolyatsijei" (Manufacturing of Electrical Cables and Wires with Rubberized Plastic Insulation), "Vysshaya Shkola" Publishers, Moscow, 1967, p. 77).

According to this method, a partial reduction of metal takes place when etching an oxidized surface of copper in a solution of sulphuric acid.

Hot working of metals results in the formation of a layer of metal oxides. Being of a high hardness and brittleness, this layer impairs conditions for the further cold working of the metal. In drawing, it is likely to increase wearing of dies, draw plates, and to choke up the drawing machine. In the process of cold rolling, there results an increase in wearing of rolls, and clogging of rolling stands with dust is inevitable. The formation of dust in the process of cold working is conducive to irretrievable losses of metal with this dust, and is likely to set up unfavorable conditions for the working personnel.

In the process of cable-manufacturing, the oxidized layer detrimentally affects the adhesive capacity of insulating materials to metal.

At the present time, the surface of the metal is cleaned of oxides by the etching process. For this purpose, etching departments are provided in factories. Etching involves the consumption of acid and soda, employment of additional equipment and special attendants. The etching process involves dissolution of copper whose recovery is connected with a number of difficulties.

To carry out etching requires loose winding (in a coil) of rolled wire or rods of a great length with a view to ensuring the penetration of the acid inside the coil, followed by washing off the copper dust reduced from oxides in the etching process.

SUMMARY OF THE INVENTION

An object of the present invention is to eliminate the above disadvantages. Other objects and advantages of the invention will become more fully apparent from the following description thereof.

It is the principal object of the present invention to provide a method ensuring the obtaining of a metal with a clean, non-oxidized surface in the process of hot working or immediately thereafter, and eliminating the etching operation involving the use of additional equipment, production floor areas, attendants, and consumption of reagents.

This object is attained by a method of reduction of an oxidized surface of copper or its alloys, according to which the oxidized surface is treated with water, an aqueous emulsion or steam, containing at least 0.15 per cent of ethyl alcohol in the process of hot working or immediately thereafter.

DETAILED DESCRIPTION OF THE PREFERRED EMBODIMENT

The nature of the present invention will become more fully apparent from a consideration of the following description of an exemplary embodiment thereof.

EXAMPLE 1.

In the process of hot pressing of articles (pipes, rods, or shapes) made of copper, 0.5 per cent of ethyl alcohol is added to the cooling water. This results in the obtaining of articles having a clean, non-oxidized surface.

EXAMPLE 2

In the process of hot rolling of copper wire rod, as carried into effect on the mill of an Italian firm "Contynuus", 0.5 per cent of ethyl alcohol is added to the emulsion for cooling and lubricating the rolls, while the final cooling of the wire rod is effected with running water in a pipe for water cooling, provided immediately after a finished stand of the rolling mill.

It has been found preferable to provide annular housings in order to decrease the consumption of ethyl alcohol due to the evaporation occuring between the stands of the rolling mill.

EXAMPLE 3

In the process of annealing wire combined with its drawing, cooling of the wire heated up to a temperature of 700° C is effected in water containing 1 per cent of ethyl alcohol.

EXAMPLE 4

In electric furnaces provided with a water seal and intended for annealing wire, it is preferred to introduce into the working chamber steam containing at least 0.15 per cent of ethyl alcohol, in order to protect the copper wire against oxidation and to reduce oxides present on the rolled wire, which oxides have been formed earlier.

The present method provides the following advantages:

an increase in the yield of the finished metal due to eliminating metal losses from oxidation by as much as 1 per cent by weight of the amount being treated;

the manufacturing of wire or other articles of metal possessing clean, non-oxidized surfaces immediately after heat treatment thereof; and the obtaining of rolled wire or rods of a great length, not only by coiling them into coils distinguished by loose winding, but also by coiling them on drums with a tight or compact winding.

The dry surface of copper rolled wire, treated according to the method of this invention, is capable of resisting oxidation for a period of about 1 month, preserving thereby rose-colored and shiny surface.

What is claimed is:

1. A method of reduction of an oxidized surface of copper or its alloys in the process of hot working thereof, which comprises treating the oxidized surface with a composition consisting of at least 0.15 per cent of ethyl alcohol and a substance selected from the group consisting of water, an aqueous emulsion and steam, while carrying out the hot working process.

2. A method of reduction of an oxidized surface of copper or its alloys in the process of hot working thereof, which comprises treating the oxidized surface with a composition consisting of at least 0.15 per cent of ethyl alcohol and a substance selected from the group consisting of water, an aqueous emulsion and steam, immediately after carrying out the hot working process.

* * * * *

REEXAMINATION CERTIFICATE (30th)

United States Patent [19]

Alekhin et al.

[11] B1 3,986,378

[45] Certificate Issued Nov. 2, 1982

[54] METHOD OF REDUCTION OF AN OXIDIZED SURFACE OF COPPER OR ITS ALLOYS

[76] Inventors: Vladimir Yakovlevich Alekhin, ulitsa F. Khodzhaeva, 18, kv. 21, Mark Moiseevich Ioff, ulitsa Vakhshskaya, 7, kv. 4; Antonina Mikhailovna Streshneva, ulitsa Pobedy, 22, all of Tashkent, U.S.S.R.

Reexamination Request

No. 90/000,003, Jul. 1, 1981

Reexamination Certificate for:

| | |
|---|---|
| Patent No.: | **3,986,378** |
| Issued: | **Oct. 19, 1976** |
| Appl. No.: | **586,861** |
| Filed: | **Jun. 16, 1975** |

Related U.S. Application Data

[63] Continuation of Ser. No. 94,156, Dec. 1, 1970, abandoned.

[51] Int. Cl.[3]..... B21B 9/00; B21B 45/04; B21C 43/00

[52] U.S. Cl......72/38; 72/39; 72/364; 148/11.5C; 148/13.2

[58] Field of Search.....72/38, 39, 46, 364, 365; 134/2, 9, 19; 148/11.5C, 13.2

[56] References Cited

U.S. PATENT DOCUMENTS

| | | | |
|---|---|---|---|
| 2,643,199 | 6/1953 | Hersch | 117/50 |
| 3,257,835 | 6/1966 | Cofer et al | 72/364 |
| 3,433,683 | 3/1969 | Osborne | 148/13.2 |
| 3,620,853 | 11/1971 | Snyder et al | 148/13.2 |

OTHER PUBLICATIONS

Wire, English Edition No. 49, Oct. 1960, pp. 201-203, Heinz Bottger, "A Contribution to the Technique of Wire Enameling."

*Primary Examiner*—E. M. Combs

[57] ABSTRACT

A method of reduction of an oxidized surface of copper or its alloys in the process of hot working thereof, in which the oxidized surface is treated with water, an aqueous emulsion or steam, containing at least 0.15 per cent of ethyl alcohol, when carrying into effect hot working or immediately thereafter.

REEXAMINATION CERTIFICATE ISSUED UNDER 35 U.S.C. 307.

AS A RESULT OF REEXAMINATION, IT HAS BEEN DETERMINED THAT:

Claims 1 and 2, having been finally determined to be unpatentable, are cancelled.

* * * * *